United States Patent [19]

Bernfeld

[11] 4,066,537

[45] Jan. 3, 1978

[54] WET MAGNETIC SEPARATION OF MATERIALS

[76] Inventor: Georg Josef Bernfeld, 114 Stamford Hall, Paul Nel St., Hillbrow, Johannesburg 2001, South Africa

[21] Appl. No.: 666,936

[22] Filed: Mar. 15, 1976

[30] Foreign Application Priority Data

Mar. 27, 1975 South Africa ..... 75/1940

[51] Int. Cl.[2] ..... B03C 1/08

[52] U.S. Cl. ..... 209/223 R; 198/580; 209/232; 210/222

[58] Field of Search ..... 209/213, 214, 215, 218, 209/223 R, 232; 210/222; 239/193, 542; 198/472, 648, 580, 604, 726, 678

[56] References Cited

U.S. PATENT DOCUMENTS

| | | | |
|---|---|---|---|
| 2,642,994 | 6/1953 | Casson | 209/218 X |
| 2,862,764 | 12/1958 | Frese, Jr. | 239/193 |
| 3,147,212 | 9/1964 | Van Koppen et al. | 239/193 X |
| 3,158,171 | 11/1964 | Eckert | 239/193 X |
| 3,352,403 | 11/1967 | Blake | 198/34 |
| 3,375,925 | 4/1968 | Carpenter | 209/232 X |
| 3,822,016 | 7/1974 | Jones | 209/223 R X |
| 3,920,543 | 11/1975 | Marston et al. | 209/232 X |

FOREIGN PATENT DOCUMENTS

| | | | |
|---|---|---|---|
| 2,130,560 | 2/1972 | Germany | 209/223 |

*Primary Examiner*—Morris O. Wolk
*Assistant Examiner*—Arnold Turk
*Attorney, Agent, or Firm*—Cushman, Darby & Cushman

[57] ABSTRACT

Apparatus for the magnetic separation of feebly magnetic materials from a slurry comprises a number of matrix containers which are movable along a path between a number of pole pairs. The slurry passes through the matrix containers and is received in launders under the path, the non-magnetic constituents being collected in launders below the pole pairs and the feebly magnetic constituents in zones of low magnetic intensity. The matrix containers can be removed from the path individually for cleaning.

15 Claims, 6 Drawing Figures

WET MAGNETIC SEPARATION OF MATERIALS

This invention relates to wet magnetic separation of materials and, in particular, to wet high intensity separators for use with feebly magnetic materials.

BACKGROUND TO THE INVENTION

The invention is concerned with such a separator of the kind comprising a matrix container means; matrix means within the matrix container means, magnetic means located in proximity to the matrix container means to establish zones of high and low magnetic intensity within the matrix container means; feed means for supplying a slurry to the matrix container means; washing means for washing material entrapped in the matrix means; launder means to receive matter discharged from the matrix container means, the launder means being arranged to receive respectively matter passing through the matrix container means at at least the high magnetic intensity and the low magnetic intensity zones; and moving means for causing relative movement between the container means and magnetic means. Such a separator is hereinafter referred to as a separator of the kind set forth.

Many known separators of the kind set forth are described in a paper entitled "Wet Magnetic Separation of Weakly Magnetic Minerals" by Lawver and Hopstock published in Minerals Science and Engineering, Volume 6, No. 3 of July, 1974, pages 154 – 172. In such known separators, the collector means normally comprises an annular collector ring or carousel, which rotates about its axis. The magnetic means comprise two or more pole pairs, the poles of each pair being located on a radius of the carousel with one within the centre of the carousel and the other outside the carousel. The matrices which may be used may comprise groove plates, salient pole plates, iron spheres, "wedge wire" bars, wire netting, steel wool, expanded metal sheets, rods, needles, bolts, helices, screens and the like. The feed means is normally located near and ahead of the zones of high magnetic intensity. Wash means are provided to remove matter entrapped in the matrix, being normally located at the low magnetic intensity zone for the magnetic material as well as at the high intensity zones for the non-magnetic materials. Further wash and launder means may be provided between these zones for middlings.

Such known separators of the kind set forth suffer from a number of disadvantages. The carousel tends to be extremely heavy. The problems of machining and/or fabricating the carousel appear, for the time being at least, to have imposed a maximum size of the carousel and hence a maximum capacity of the separator. The geometry of the carousel imposes limitations on the poles.

Further should the matrix become clogged, the entire separator must be shut down for the cleaning of the matrix.

SUMMARY OF THE INVENTION

According to one aspect of the invention there is provided a separator of the kind set forth wherein the matrix container means comprises a series of removable and replaceable separate matrix container units which are moveable in a path through the zones of high and low magnetic intensity.

The path is preferably an endless path. Preferably guide means are provided for guiding the container units along the path. Such guide means preferably includes rigid support means for locating the units firmly when moving between the poles of the pole pairs.

The separator normally further comprises moving means for moving the container units along the path. Preferably the container units are arranged butting up against each other and the moving means applies force to a rearwardly located unit, and that unit pushes those forwardly of it. The container units may be operatively connected to each other. This is particularly desirable where the moving means pulls the container units. The units may be connected to each other through couplings or may be connected to a belt or the like.

The path may take any convenient shape. Typically the path may comprise two straight sections joined by semi-circular end sections. The path may also contain sections at which the container units are inverted or tilted at zones of low magnetic intensity so as to allow for improved cleaning of the matrices.

The matrix of each unit may be secured within the matrix carrier unit. Alternatively the matrix may be removable from the unit to facilitate the cleaning of the matrix.

The matrix container unit may comprise a pair of side walls joined together by one or more cross-pieces where the matrix is rigid and comprises expanded metal plates or the like. The side walls may be supplemented by a base and end walls preferably in the form of a single pressing where the matrix comprises discrete particles. The matrix container units described in the preceding two sentences would normally be used where the container units are in abutting and pushing relationship as mentioned above.

Where the container units are being pulled along, these units preferably overlap when in the proximity with the feed means, so that spillage will be kept to a minimum which minimum preferably, at least, very closely approaches zero.

The separator may be used in a number of ways. Thus the separator may remove feebly magnetic impurities from a mixture of non-magnetic materials and feebly magnetic impurities. Alternatively, the separator may remove feebly magnetic materials from a mixture of such materials and non-magnetic impurities. Yet again, the separator may be used for separating magnetic and non-magnetic products both of which are required. It can also be used to remove strongly magnetic materials and feebly magnetic materials from non-magnetic materials.

Typically, the separator may be used for separating haematite or goethite from a non-magnetic carrier or for reducing the content of iron containing impurities from phosphate concentrates, or for removing weakly magnetic impurities from kaolin clay. Other uses of the separator are as described in the literature for known separators of the kind set forth (see, for example, Lawver & Hopstock supra).

The magnetic means conveniently provide a magnetic field of the order of 5 to 22 kilogauss, but the precise amount required can be determined by experiment.

Embodiments of the invention will now be described by way of example with reference to the accompanying drawings.

SHORT DESCRIPTION OF THE DRAWINGS

DESCRIPTION OF PREFERRED EMBODIMENTS

Figure 1:
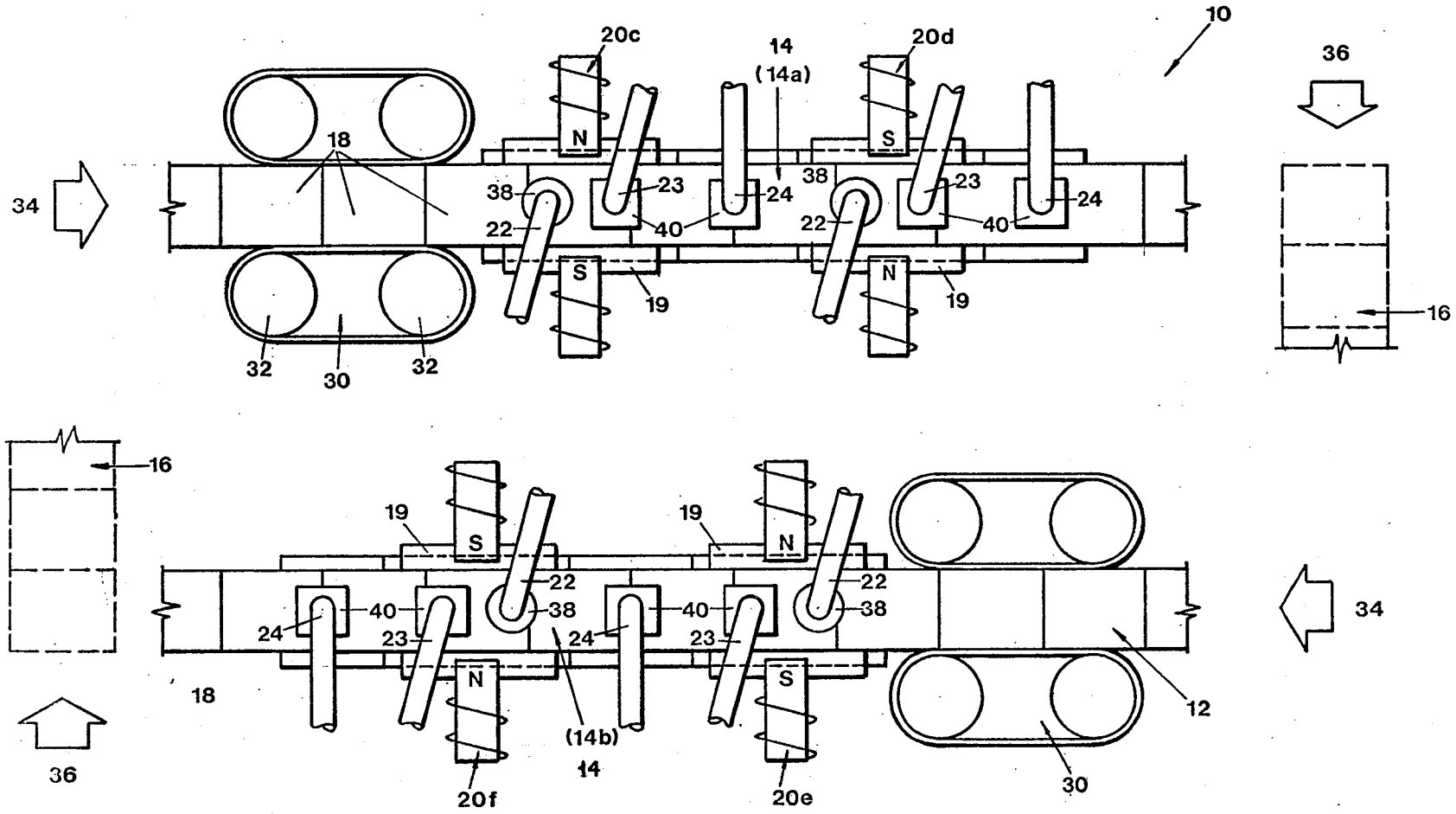
FIG. 1 is a schematic plan of a wet high intensity magnetic separator of the invention.
Figure 2:
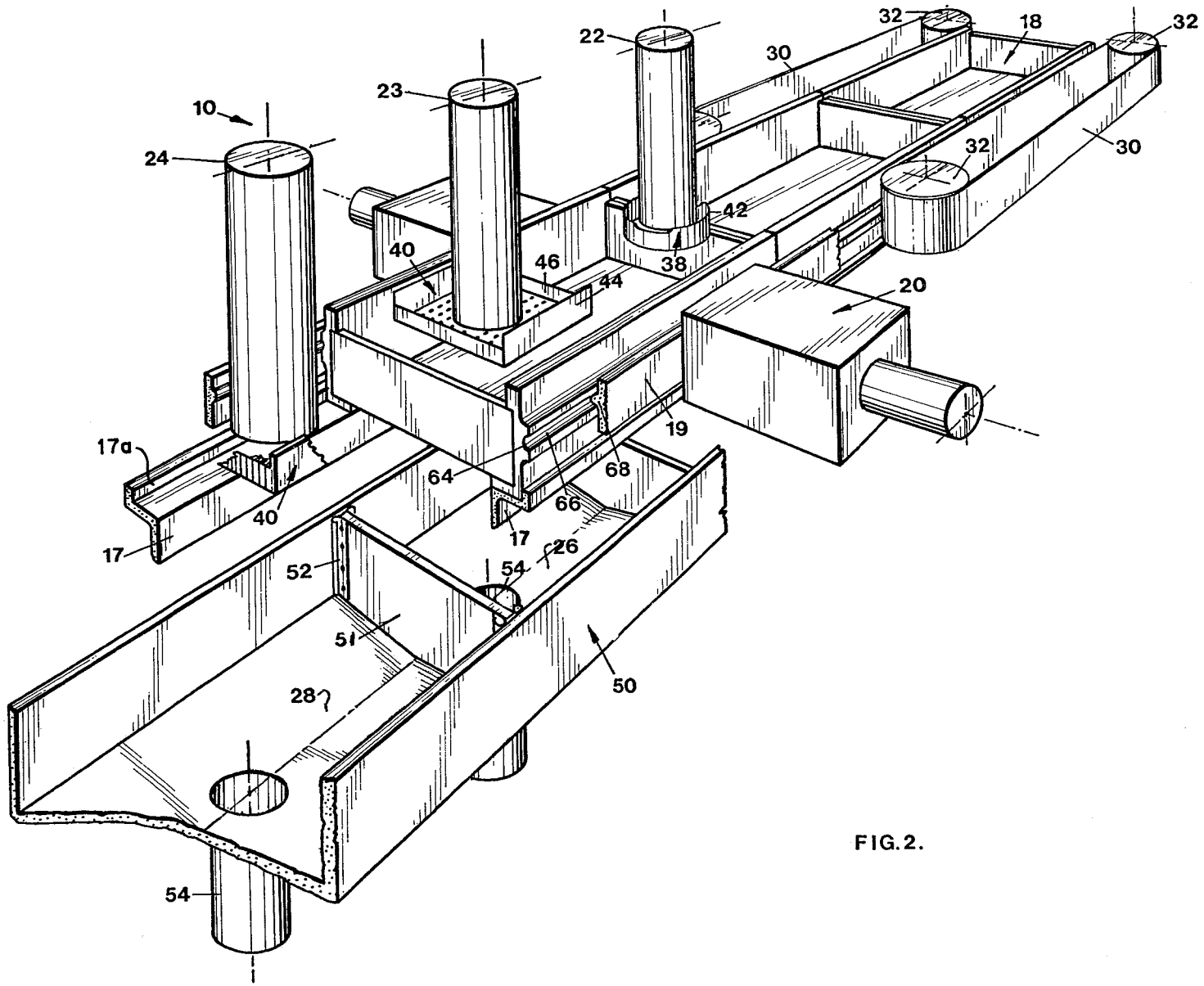
FIG. 2 is a detail perspective view of a part of the separator of FIG. 1.

Referring now to FIGS. 1 and 2, there is shown a wet high intensity magnetic separator 10 of the invention. The separator 10 comprises a horizontal path 12 having two elongated parallel sections 14 and two straight transfer sections 16 at right angles thereto. On this path 12, there are a number of matrix units 18. Below the parallel sections 14 there are angle slider guides 17 with alignment lips 17*a* (see FIG. 2) along which the matrix units 18 can move. These guides are supplemented at the pole pairs (to be described) by robust side supports 19 for engaging the sides of the units 18 when they pass between pole pairs as will be described.

Four pole pairs 20 are provided with the poles of each pair being located on either side of the parallel sections 14. Two pole pairs 20*c* and 20*d* are located adjacent one section 14*a* and the other two pole pairs 20*e* and 20*f* are adjacent section 14*b*. The arrangement of the pole pairs is such that alternate poles along a section are of opposite polarity. Thus, in the embodiment, the left hand (considered from the direction of movement of the units) pole of pole pair 20*c* is a north pole, whilst the left hand pole of pole pair 20*d* is south. The left hand pole of pole pair 20*e* is south and of pole pair 20*f* is north. The pole pairs are preferably, as shown in FIG. 2, disposed at right angles with respect to the direction of movement of units 18.

Feed pipes 22 are located above the unit 18 respectively just ahead of the pole pairs 20. Wash pipes 23 and 24 are provided. The wash pipes 23 are located at or slightly beyond the pole pairs while wash pipes 24 are located at zones of low magnetic intensity, i.e. on each section midway between two pole pairs and near the end of the section remote from the last pole pair in that section. If necessary, additional magnetic means such as an alternating magnetic field may be provided to ensure low average magnetic intensity on such zones.

Launders 26 and 28 are provided respectively below and extending somewhat beyond the pole pairs and the zones of low magnetic intensity.

At the front end of each section 14, there is provided a pusher device 30. This device comprises a pair of belts running respectively between two pairs of rollers 32, one roller of each pair being driven in conventional manner. The belts are urged into close engagement with the units 18 so as to apply an advancing force thereto. The belts 30 will engage (a) the forward end of a unit advanced slightly from the transfer section 16, (b) the first unit wholly on the section 14, and (c) the rear part of the second unit on the section 14.

The frictional engagement between the belt and the units 18 will be such that sufficient force will be applied to push the units 18 along the section 14. If, however, more positive engagement is required, the belt 30 may be a toothed belt or may be replaced by a chain, and sprocket type teeth will be provided on the units to be engaged by the chain.

An hydraulic ram or similar pusher indicated diagrammatically at 34 is provided at each transfer section 16, to assist the initial movement of the unit on to the section 14. A further similar pusher 36 is provided at each transfer section to push a unit which has left one section (e.g. 14*a*) to a position in which it is aligned with the other section (14*b*) to be engaged by pusher 34. If desired, an accelerator (not shown) may be provided to accelerate the units 18 over the last part of each section 14 and thence on to the transfer section and vice versa.

The launders 26 and 28 are formed by channel section members 50 which run below each path section 14. This member 50 is somewhat wider than the width of the units 18 to minimize spillage. The member 50 is divided into the launders 26 and 28 by transverse walls 51. These walls 51 are secured to the sides of the member 50 by means such as a flexible spring 52 so as to enable the position of the walls 51 to be easily adjusted as desired. Discharge pipes 54 lead from the bases of the launders to lead the material therein to suitable collectors. If desired, the base of the member 50 may slope towards the discharge pipes both from the sides of member 50 and/or the walls 51.

The arrangment thus shown is intended for use only where magnetic and non-magnetic material is to be taken off. In certain circumstances, however, middlings are required and for such purposes an intermediate third launder is provided between the launders 26 and 28.

The various feed and wash pipes 22, 23 and 24 are required to feed liquid at a high volume to the units 18. In order to prevent undue spillage, receivers 38 and 40 are provided at the outlets from the feed wash pipes respectively. The receiver 38 for the slurry is generally circular in plan with a circular peripheral wall 42 having a diameter which is at least twice that of the feed pipe 22. The receivers 40 are square in section with straight walls 44 and 46. The walls 44 running in the direction of the conveyor are somewhat higher than the walls 46 running transversely thereto. Thus the washing water will spill over the transverse walls 46. In addition, the receivers 40 may have openings therein through which the washing water can pass.

It will be seen that the head of the slurry or water will be dissipated in the receivers and that the liquid will spill over the walls (which act as weirs) at very low pressures. Further as will be described more fully below, the upper edges of the weirs are located at or below the upper edges of the side walls of the units. This still further reduces the amount of spillage.

Figure 3:
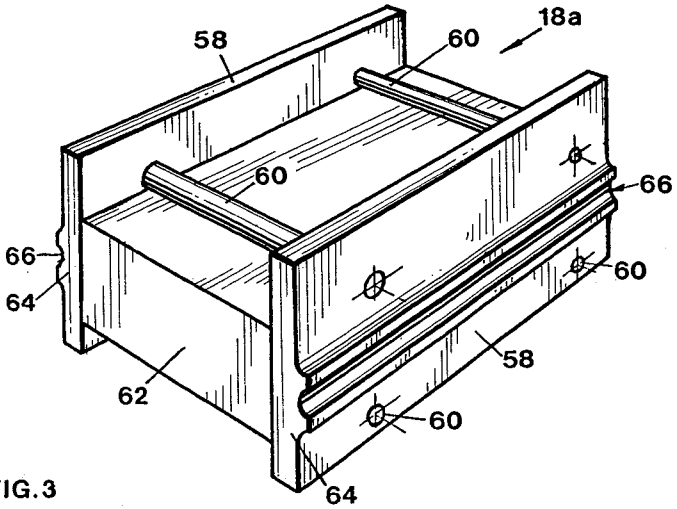
FIG. 3 is a detail perspective view of a matrix container unit.

One form of matrix container unit is shown in FIG. 3. This unit 18*a* comprises a pair of rigid side pieces 58 made of non-magnetic material, eg. suitable plastic, stainless steel, brass or aluminium. The side pieces 58 are connected together by tie bars 60 also of non-magnetic material and between these side pieces 58 is located a rigid matrix 62. The matrix conveniently comprises expanded metal plates 62 (although it can comprise any one of the other types of rigid members as above described). These plates 62 comprise a high permeability metal of low remanence such as wrought iron low carbon irons or appropriate alloys. The plates 62 extend to ends of the side pieces 58 so that when the ends of the side pieces abut, as will be described, the ends of the metal plates will also be touching.

The height of the plates 62 is such as to correspond with the height of the pole pairs and the side pieces 58 extend upwardly so that the receivers 38 and 40 can be accommodated therebetween with the upper edges of their walls located below the upper edges of the side pieces 58. This will serve to prevent or limit spillage as has been described.

A raised portion 64 with a re-entrant groove 66 therein runs along each side piece 58 to engage correspondingly shaped noses 68 on the side supports 19. It will be appreciated that there will be very large forces exerted between the pole pairs 20 and that the side supports 19 and side pieces 58 must be sufficiently strong to withstand these forces. It will also be appreciated that the side supports 19 must extend some way on either side beyond the pole pieces 20 to ensure that the matrix units 18 are supported throughout their passage through the pole pairs 20. If thought desirable, the central raised portion 46 may be replaced by a pair of raised portions at the upper and/or lower parts of the side pieces 58. A correspondingly shaped side support would then be provided. Other suitable side pieces may be used.

Figure 4:
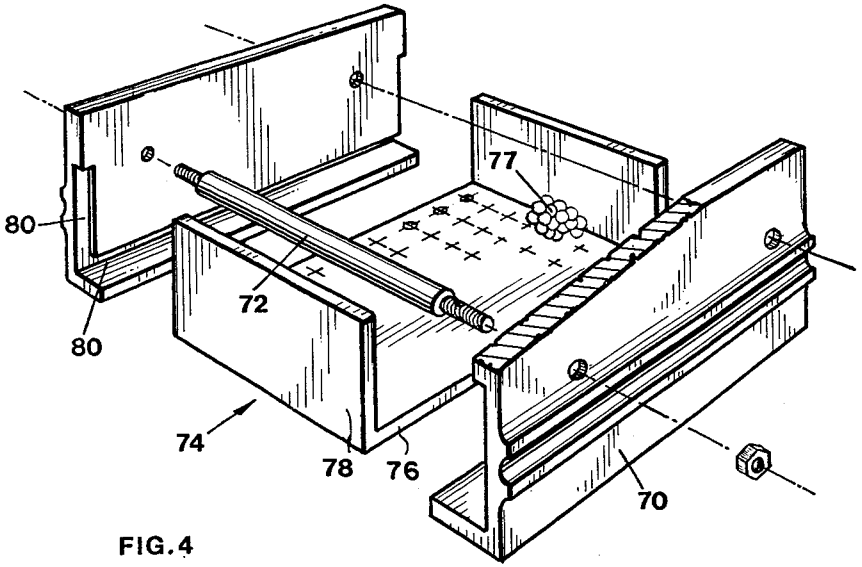
FIG. 4 is a similar view of another matrix container unit.

The matrix container unit **18*b* shown in FIG. 4 is the same as that illustrated in FIG. 2. It is normally used with a matrix comprising discrete particles. The unit 18*b* comprises side pieces 70 and tie bars 72 which are substantially identical to side pieces 58 and tie bars 60 of the FIG. 3 embodiment. A "U" shaped member 74 made of non-magnetic material provides a base 76 and end walls 78 for the unit. This member 74 fits into recesses 80 in the side pieces 70**.

The height of the side pieces 70 and the end walls 78 is such that the receivers 38 and 40 can be accommodated between the side pieces with the upper edges of the receiver walls located below the upper edges of the side pieces 70. Thus here again spillage will be minimize. It will be appreciated of course that the height of the tie bars must be below the location of the bases of the receivers, to enable them to be accommodated as above described.

The base 76 of the member 74 is apertured. The size and number of the apertures is such that the slurry can pass therethrough in a substantially uninterrupted manner, but that the matrix particles will be retained within the unit. The particular matrix for use with the unit **18*b*** comprises spheres.

Figure 6:
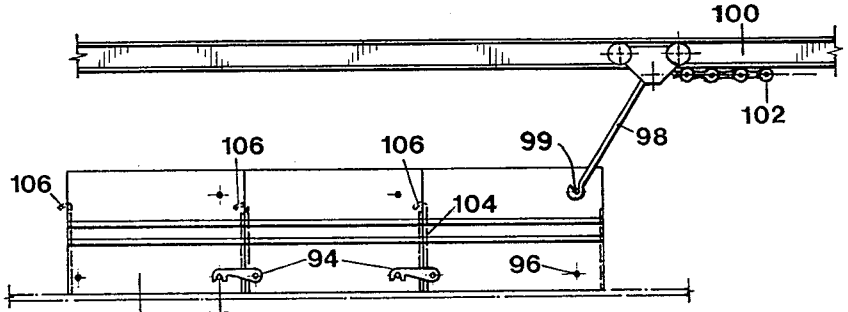
FIG. 6 is a detail of two matrix container units of the invention and puller means for moving them in a separator of the invention.

The rear wall of the member may have a rolled over lip as shown in FIG. 6 which passes over the front wall of the adjacent member to prevent the slurry passing between adjacent units.

The dimensions of the units may vary as desired subject to this:

a. the units must fit closely between the poles of a pole pair, and b. the length of each unit should preferably be at least twice as long as the effective length of the pole pieces.

The units 18 are placed on the path and are advanced by the belt 30 with rear units pushing the units before them. With the units **18*a* (see FIG. 3) the matrices 62 of adjacent units will butt against each other. Thus these matrices on the path 14** form, as it were, a continuous matrix member.

The slurry is applied through the feed pipes 22. Feed pipes 22 are preferably disposed, as shown in FIG. 2, to cause the feed direction of the slurry to be at right angles with both the lines of force between pole pairs 20 and the direction of movement of container units 18. As the units 18 pass through the pole pairs 20, the weakly magnetic material is removed from the slurry and the non-magnetic concentrate passes into the launders 26. The wash water from the wash pipes 23 assist in cleaning the non-magnetic material from the matrix. The unit 18 then moves to the zone of low magnetic intensity where the washing liquid is fed from the wash pipes 24 washing the magnetic concentrate into the launders 28. The units are moved from one section 14 to the other at the transfer sections. If desired, units may periodically be removed at the transfer sections and others replace them. The removed units can then be subjected to a more thorough cleaning elsewhere than occurs at the wash stations.

The invention is not limited to the precise constructional details above described, and a number of modifications will be described below.

DESCRIPTION OF MODIFICATIONS

Figure 5:
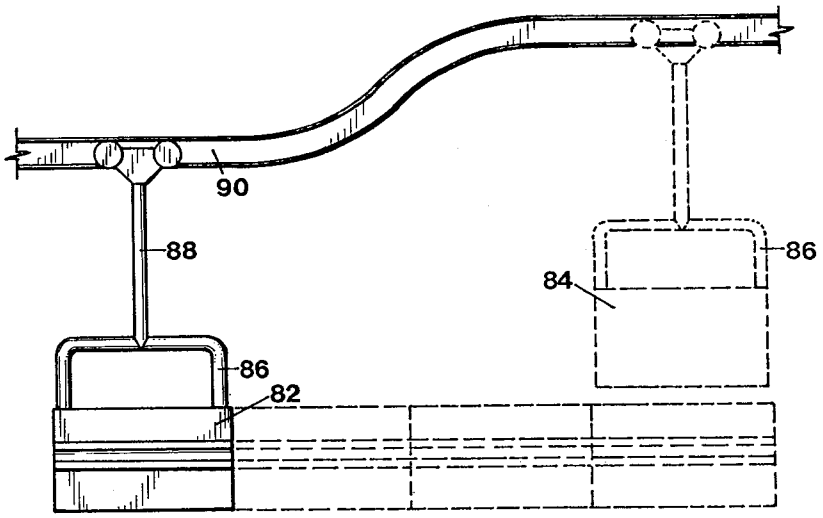
FIG. 5 is a side view of a detail of a separator of the invention in which the matrix container units include a sub-assembly containing the matrix.

As shown in FIG. 5, the matrix containing units 82 may each comprise a sub-frame 84 containing the matrix. The sub-frame 84 is removable from the main body of the unit. This sub-frame 84 is preferably provided with side handles 86 adjacent the side pieces. These side handles 86 are connected to a dependent member 88 of an overhead conveyor 90. At the end of each section 14 the conveyor 90 rises so that the sub-frame 84 are lifted out of the units. Sub-frame 84 are replaced in similar manner at the commencement of each section 14. With this arrangement, the matrix can be more easily cleaned and extraneous matter e.g. a strongly magnetic material, or dirt which has become lodged in the matrix can be removed. In this way, clogging or fouling of the unit can be eliminated before its significance effects the operation of the apparatus.

If the matrix comprises plates, these too could be removably located in the sub-frames for the same purpose.

Where the matrix comprises discrete particles (especially when it comprises spheres) it can be spilled out of the sub-frames for cleaning purposes. This additional cleaning preferably is effected by high pressure water jets located away from the path 12. Additionally, or alternatively, cleaning can be effected by tumbling or by electromagnetic means, e.g. by an alternating current demagnetiser.

The frequency of this additional cleaning may be chosen as desired.

As shown in FIG. 6 the matrix containing units 92 may be connected by couplings 94. The units have side projections 99 that can be engaged by hooks 98 on an overhead conveyor 100. A chain device 102 pulls these hooks 98 to pull the units 92 along the path 12. The couplings 94 are such that units 92 can easily be uncoupled (e.g. for cleaning purposes) and re-coupled.

The end walls 104 of the units 92 are lower than the side pieces for the reasons above described. Lips 106 extend from one unit 92 over the end wall of an adjacent unit to prevent spillage between the units 92. These lips 106 make a generally leakproof contact with the side pieces. This arrangement will normally only apply with an endless path.

As an alternative, the units may be connected to an endless chain or belt, in which case the necessity for couplings may be obviated. The side plates of the units may have teeth formed on them and, instead of a belt, a drive gear may be provided for propelling the units.

The matrix may comprise any suitable known material. In addition to spheres (also known as "spheripoles") and expanded metal plates, the matrix may comprise, for example grooved or pressed plates, wire mesh or wire wool. The nature of the matrix should be tailored to suit the characteristics of the material being handled. Because the matrix clogging and wear and tear characteristics can be found with tests on one unit at a time, one may obviate the extremely costly testing using a matrix on an entire carousel as is now necessary in view of the poor guide to these characteristics available from small scale laboratory testing. Further, the testing of a new matrix in one or two units can take place during and without interruption of normal operation of the separator. The units containing the new matrix can be removed for inspection when desired. Thus, parameters such as, for example, spheripole diameter may be optimised over a period of months without interrupting continuous operation of the separator.

The length of the straight sections 14 can be varied and the number of pole pieces increased as desired. The distance between the pole pairs may vary as required e.g. by magnetic properties of the material but typically this distance would be about two meters. Indeed, it will be seen that the length of these path sections in any separator and the number of pole pieces at that section can be changed with a minimum of difficulty to change the capacity of the separator. This gives the separator great flexibility. The separator may be designed on a modular basis and can be built up from standard units. Further the configuration of the path may be different from that described.

If desired the path may be endless with semi-circular end portions.

The receivers for the slurry and wash water can be of any desired shape in plan with one or more walls or wall sections lower than the other to form one or more weirs.

In addition to the advantages mentioned above, the separator will be very economical to manufacture as compared to conventional separators of similar capacity.

The location of the feed pipes and the receivers may be varied both vertically and in the direction of the path within certain limits.

The side pieces may have sideways projecting lips for additional splash protection. The or additional side supports may act against these lips. The side supports may be so located that the pole pieces are close to the side pieces of the matrix container units.

The apparatus can be used for removing strongly and feebly magnetic material from non-magnetic material. One way of doing this is to have the feebly magnetic material released at the low magnetic intensity zones and the strongly magnetic material removed at separate cleaning areas to which the units are removed.

All the contructional material such as the guides, side supports, the launders, should be made of non-magnetic material. The path may also be square or any other conventional shape.

I claim:

1. In a separator of the type including:

magnetic means for establishing zones of high and low magnetic density;

matrix container units comprising a series of separate matrix container units which are movable in a path through said zones of high and low magnetic intensity;

matrix means within each matrix container unit;

feed means supplying slurry to said matrix container means;

washing means for washing out material entrapped in the matrix means;

launder means receiving respectively matter passing through said matrix container means at at least said high magnetic intensity zone and said low magnetic intensity zone; and moving means operatively connected to said container means for moving said matrix container means through said high and low magnetic intensity zones;

the improvement wherein the moving means comprises a path through said zones established by said magnetic means, means for transferring said container units onto said path, and means for providing a moving force to said units to move the container units as a continuous matrix through the magnetic zones, and wherein the matrix container units are removable and replaceable when in the means for transferring without interrupting the continuous movement of the container units along said path.

2. The separator claimed in claim 1 in which the path comprises two straight sections and said path sections are joined by said means for transferring, said means for transferring comprising straight horizontal transfer sections.

3. The separator claimed in claim 1 in which the matrix means is removably received within the matrix container unit.

4. The separator claimed in claim 1 further comprising pulling means for pulling the matrix container means through the said path and additionally each matrix container unit has releasable connecting means connecting together matrix container units on the path.

5. The separator claimed in claim 1 wherein each matrix container comprises side members and ends between which the matrix is secured and wherein the ends of the matrix containers butt against each other.

6. The separator claimed in claim 1 further comprising pulling means for pulling the matrix container units along the path, wherein the said matrix container units each having end walls and on one of the said end wall a lip which passes over the other of the said end walls of an adjacent matrix container.

7. The separator claimed in claim 6 in which each matrix container unit has side walls extending upwardly beyond the lips.

8. The separator claimed in claim 1 in which the matrix container units removably receive carriers and in which the matrix means are carried in the carriers.

9. The separator claimed in claim 8 further comprising conveyor means located above the path and including means to engage and remove the carriers from the matrix container units.

10. The separator claimed in claim 1 in which the feed means includes means whereby the slurry is fed to the container units at a very low pressure.

11. The separator claimed in claim 10 in which the said means comprises a receiver into which the feed means discharges the slurry the said receiver having weir means over which the slurry passes to enter the matrix container units.

12. The separator claimed in claim 11 in which the matrix container units have sides that extend above the upper edge of the weir.

13. The separator claimed in claim 1 wherein said magnetic means comprises at least one pole pair and the direction of movement of the matrix containers in each path, the lines of force between the pole pairs and the feed direction of the slurry are mutually at right angles.

14. The separator claimed in claim 13 wherein the length of each matrix container is greater than the length of each pole pair, and further comprising guide means located on either side of each pole pair engaging and rigidly holding the matrix container units as they pass between the pole pair.

15. The separator claimed in claim 14 wherein the container units have rigid side pieces, each having a guiding groove therein and the guide means comprise noses slidably received in the grooves.

* * * * *